US005378128A

United States Patent [19]

Yanagisawa

[11] Patent Number: 5,378,128

[45] Date of Patent: Jan. 3, 1995

[54] MULTI-STAGE SCREW VACUUM PUMP

[75] Inventor: Kiyoshi Yanagisawa, Kanagawa, Japan

[73] Assignee: Ebara Corporation, Tokyo, Japan

[21] Appl. No.: 86,886

[22] Filed: Jul. 7, 1993

[30] Foreign Application Priority Data

Aug. 5, 1992 [JP] Japan ..... 4-208741

[51] Int. Cl.[6] ..... F01C 1/30

[52] U.S. Cl. ..... 418/9; 418/202; 184/13.1

[58] Field of Search ..... 418/5, 9, 10, 202; 184/11.1, 13.1

[56] References Cited

U.S. PATENT DOCUMENTS

| | | | |
|---|---|---|---|
| 2,691,482 | 10/1954 | Ungar | 418/9 |
| 2,937,807 | 5/1960 | Lorenz | 418/9 |
| 2,981,373 | 4/1961 | Van Raust | 184/11.1 |
| 3,407,996 | 10/1968 | Olofsson et al. . | |
| 4,068,984 | 1/1978 | Spindler | 418/9 |
| 4,076,468 | 2/1978 | Persson et al. | 418/9 |

FOREIGN PATENT DOCUMENTS

| | | |
|---|---|---|
| 0096668 | 12/1983 | European Pat. Off. . |
| 0166807 | 1/1986 | European Pat. Off. . |
| 62-284994 | 12/1987 | Japan . |
| 3-70119 | 11/1991 | Japan . |

OTHER PUBLICATIONS

Patent Abstracts of Japan, vol. 11, No. 78 (M-570), Mar. 10, 1987, JP-A-61 234 290, Oct. 18, 1986.

*Primary Examiner*—Richard A. Bertsch
*Assistant Examiner*—Charles G. Freay
*Attorney, Agent, or Firm*—Oblon, Spivak, McClelland, Maier, & Neustadt

[57] ABSTRACT

A multi-stage screw vacuum pump having a reduced number of constituent parts as compared with the conventional one and a reduced overall size. The multi-stage screw vacuum pump comprises an input mechanism for transmitting a driving force derived from a driving source to a former-stage pump, and speed up mechanisms for speeding up the rotation of the former-stage pump for transmission to a latter-stage pump.

4 Claims, 8 Drawing Sheets

MULTI-STAGE SCREW VACUUM PUMP

BACKGROUND OF THE INVENTION

FIELD OF THE INVENTION

The present invention relates to a screw vacuum Dump including a pair of male and female rotors rotatable around respective axes parallel to each other in a meshing manner, and more particularly to a multi-stage vacuum pump comprised of plural stages of screw vacuum pumps provided in series.

PRIOR ART

Figure 7:
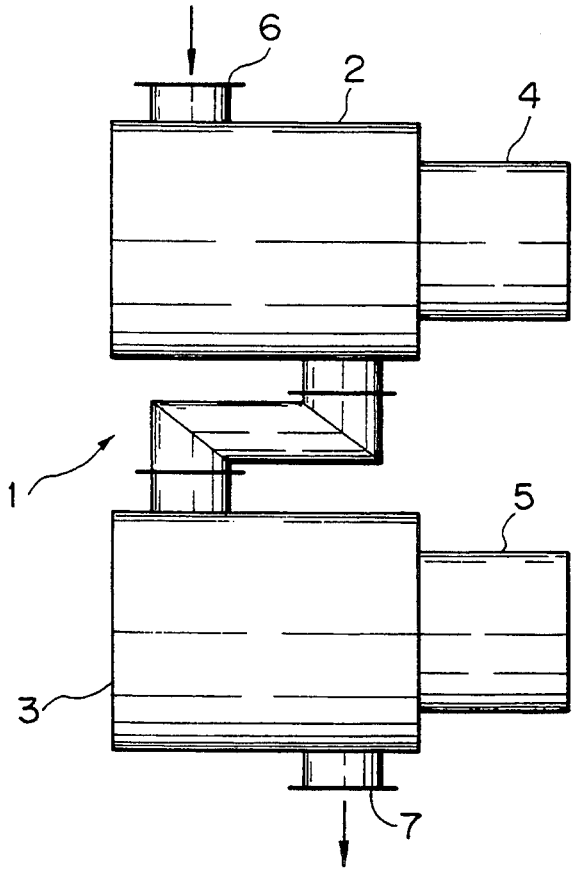
Fig.7 PRIOR ART
FIG. 7 is a block diagram showing an example of the prior art.
Figure 9:
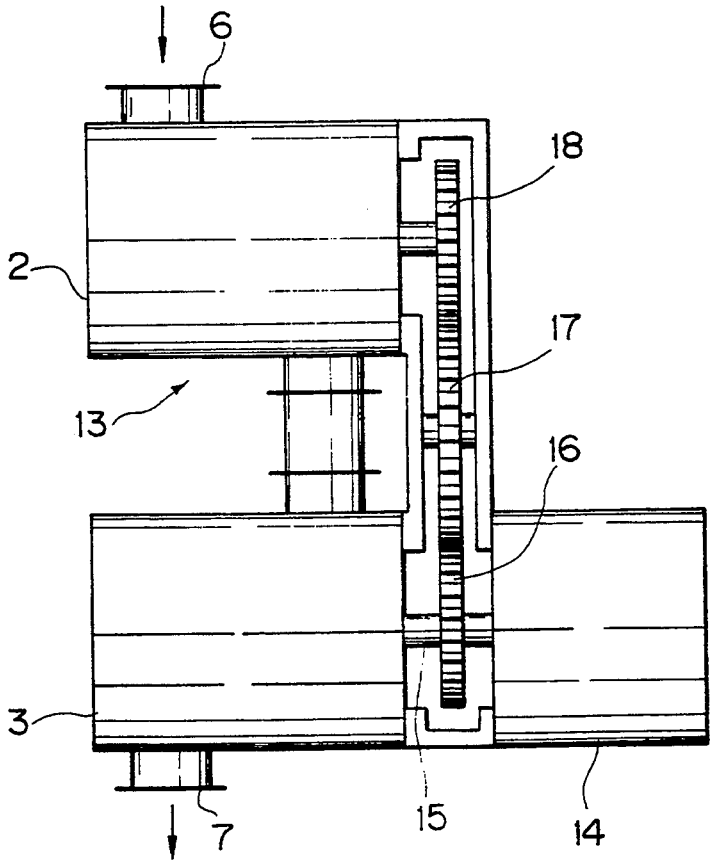
Fig.9 PRIOR ART
FIG. 9 is a block diagram showing a further example of the prior art different from those shown in FIGS. 7 and 8.

FIGS. 7 and 9 depict conventional multi-stage screw vacuum pumps.

Referring first to FIG. 7, there is shown a multi-stage screw vacuum pump 1 which comprises a former-stage pump 2 and a latter-stage pump 8 having motors 4 and 5, respectively, serving as a driving source. Besides, reference numeral 8 denotes a suction port, and 7 denotes a discharge port.

Figure 8:
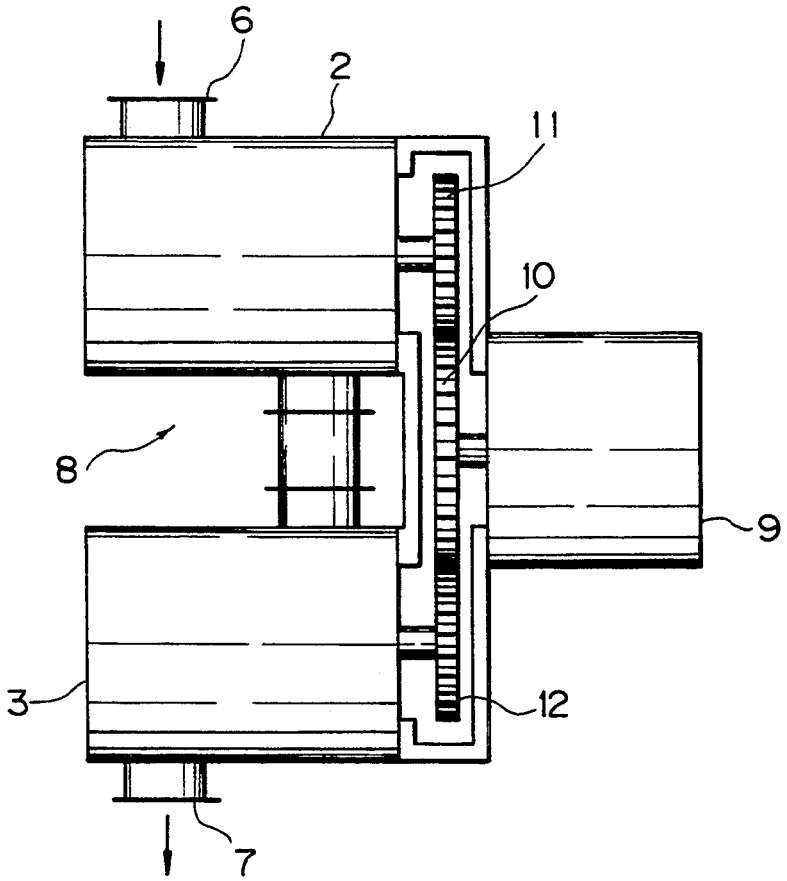
Fig.8 PRIOR ART
FIG. 8 is a block diagram showing another example of the prior art.

Referring second to FIG. 8, there is shown a multi-stage screw vacuum pump 8 having a single motor 9 whose output is transmitted via a driving gear 10, a driven gear 11 engaged with the driven gear 10 and associated with the former-stage pump 2, and a driven gear 12 associated with a latter-stage pump 3, to the former-stage pump 2 and the latter-stage pump 3.

Referring third to FIG. 9, there is shown a multi-stage screw vacuum pump 13 also having a single motor 14 whose output shaft 15 is directly connected to the latter-stage pump 3. In this case, the drive force transmitted to latter-stage pump 3 is distributed via a drive gear 16, an idle gear 17 and a driven gear 18 to the former-stage pump 2.

PROBLEMS WHICH THE INVENTION IS TO SOLVE

The multi-stage screw vacuum pump 1 shown in FIG. 7 involves a problem that the number of constituent parts is increased and the entire size of the pump is enlarged since two motors (designated at reference numerals 4 and 5 in FIG. 7) are required.

In the multi-stage screw vacuum pump 8 shown in FIG. 8, there is a need to provide bearings on the motor 9 as well as to provide a driven gear on the pump of each stage, which leads to an increase in the number of constituent parts and enlargement of the overall size of the pump, as in the multi-stage screw vacuum pump 1 in FIG. 7.

The multi-stage screw vacuum pump 13 shown in FIG. 9 entails such problems. Moreover, it is necessary to effect inverter-drive by use of a high-frequency motor in case that high-speed operation of the latter-stage pump in required.

For a multi-stage screw vacuum pump, high-speed rotation is an effective means in view of the reduction in size of the pump body as well as the improvement in performance.

As a means for increasing rotational speed, there may be employed a high-frequency motor for inverter-drive, or alternatively, a mechanical speed-up means such as a speed-up gear or belt, which in either case inevitably leads to an increase in the number of constituent parts and production costs.

The inverter-drive method entails such problems that an inverter device takes a great deal of space, and that it takes a certain time to return to its full speed once the rotational speed is reduced at the time of power failure, during which the vacuum may be broken. It is therefore advantageous to use a mechanical speed-up means as employed in the present application. The employment of tile belt-drive method as a mechanical speed-up means involves such problems as a restricted belt life and a restricted speed-up ratio within a limited space. It is therefore advantageous to use a speed-up gear as in the present invention.

In the case of a method where a drive gear constituting a speed-up gear is attached to the motor, and driven gears are separately provided on the former-stage pump and latter-stage pump in order to speed up the two pumps (FIG. 8, Japanese Patent Publication No. 3-70119), the motor section requires bearings and a motor shaft, and a lubrication mechanism must be separately provided due to the difficulty of lubricating the bearings (in particular, on the side opposite to the gear) by exclusively using an oil splasher within a gear chamber. Although a grease sealing type bearing may be employed for the motor section, there must be provided three or more speed-up gears and a seal mechanism for preventing the oil within the gear chamber from entering the interior of tile motor chamber.

SUMMARY OF THE INVENTION

The present invention was conceived in view of the problems involved in the prior art described above, of which the object is to provide a multi-stage screw vacuum pump capable of reducing the number of constituent parts to enable a reduction in the overall size off the pump. It was conceived to both directly connect the pump to the motor and to speed up only the pump, to thereby minimize the number of constituent parts while balancing cost against performance and size. It was found that speed-up of the latter-stage pump is advantageous from the viewpoint of an improvement in performance and a reduction in size since the load to be exerted on the latter-stage pump is larger than that on the former-stage pump in the multi-stage type. Simultaneously, this can minimize the number of noise generating engaging gears.

MEANS FOR SOLVING THE PROBLEMS

A multi-stage screw vacuum pump constructed in accordance with the present invention comprises plural stages of screw vacuum pumps provided in series, each stage including a pair of male and female rotors rotatable around respective axes parallel to each other in a meshing manner, wherein there are provided an input mechanism for transmitting a drive force derived from a drive source to a first pump, and a speed up mechanism for speeding up the rotation of the first pump for the transmission to a second pump.

Preferably, the drive source can be, for example, an electric motor. Also preferably, the input mechanism can be a mechanism in which an output shaft of the drive source (electric motor) is linked with a rotor shaft of the first or former-stage pump.

For the execution of the present invention, the motor should overhang the former-stage pump.

Preferably, the output shaft of the motor is connected to a shaft of the female rotor of the former-stage pump. In this case, the motor preferably overhangs the discharge side of the former-stage pump.

Preferably, the speed up mechanism comprises speed up gears including a speed up driving gear and a speed up driven gear. The speed up driving gear is preferably provided on the discharge side of the former-stage pump, or alternatively, on the shaft of the female rotor of the former-stage pump. On the other hand, the speed up driving gear is preferably provided on the discharge side of the second or latter-stage pump, or alternatively, on the shaft of the female rotor of the latter-stage pump.

In addition, for the execution of the present invention a discharge port of tile former-stage pump and a suction port of the latter-stage pump are preferably comprised of a common casing. In this case, a communication passage through which the discharge port of the former-stage pump communicates with the suction port of the latter-stage pump may be entirely or partially comprised of the common casing.

For the execution of the present invention, lubrication is preferably carried out through so-called "splash" by use of an oil disk. In this ease, the oil disk may be attached to both the former-stage and latter-stage pumps, or either one.

OPERATION OF THE INVENTION

According to the multi-stage screw vacuum pump of the present invention having the above-described constitution, the drive force derived from the drive source is transmitted via the input mechanism to the former-stage pump, and then via the speed up mechanism to the latter-stage pump. Since the speed up mechanism serves to speed up the rotation of the former-stage pump for transmission to the latter-stage pump, there is no need to use a high-frequency motor for inverter-drive even though the latter-stage pump is required to be operated at a higher speed.

The provision of the input mechanism eliminates not only the necessity of separately providing bearings to support the drive source (for example, motor), but also the necessity of providing a driven gear for each of the stages.

For these reasons, the multi-stage screw vacuum pump of the present invention has a far lower number of constituents parts than tile conventional one, and hence is smaller in size.

The present invention further enables the actuation or the overload operation such as air drawing without externally providing any additional auxiliary device.

DESCRIPTION OF THE PREFERRED EMBODIMENT

Embodiments off the present invention will be described hereinbelow with reference to FIGS. 1 to 6.

Figure 1:
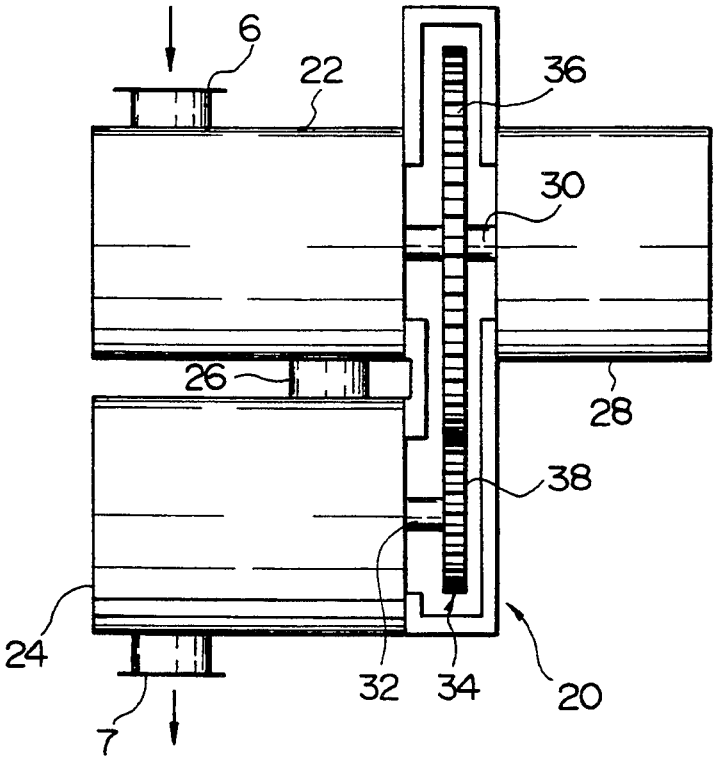
FIG. 1 is a block diagram of an embodiment in accordance with the present invention.
Figure 3:
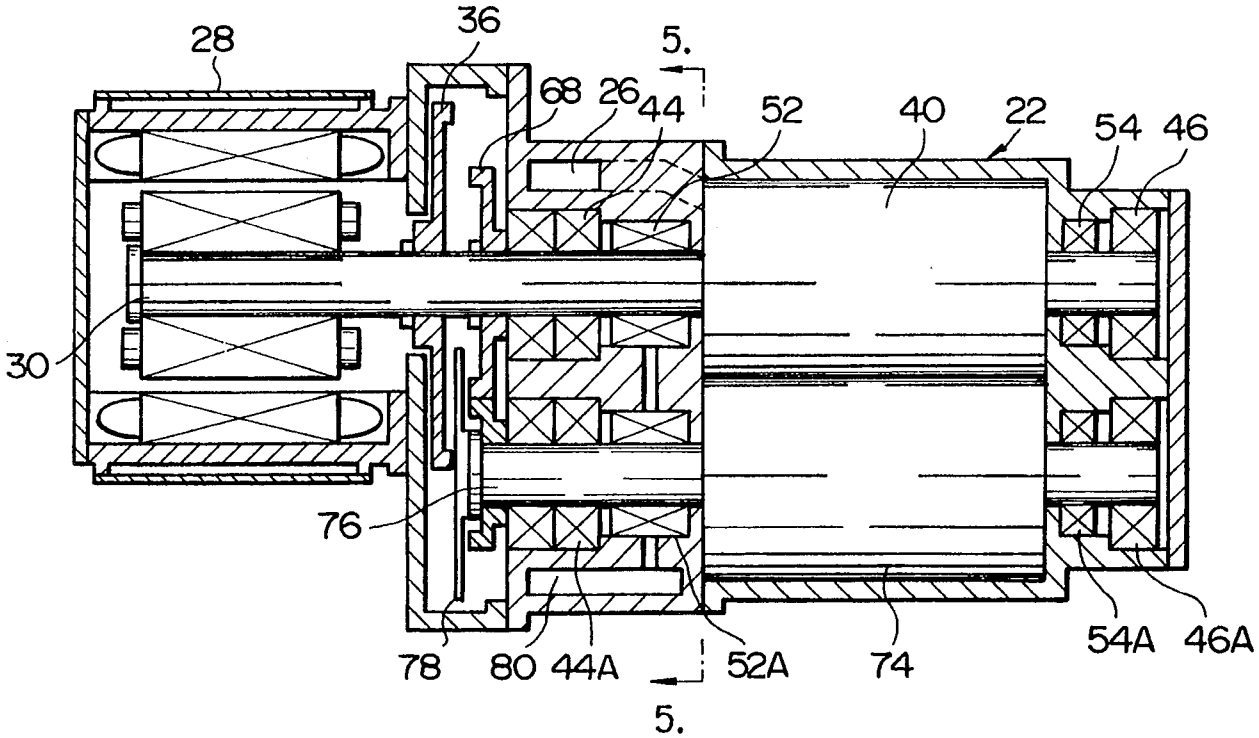
FIG. 3 is a sectional view taken along the line A—A in FIG. 2.

Turning to FIG. 1, there is shown a multi-stage (two-stage in the illustrated embodiment) screw vacuum pump of the present invention generally designated at reference numeral 20 and comprising a first or Former-stage pump 22, a second or latter-stage pump 24, a communication passage 26 for linking the former-stage pump 22 with the latter-stage-stage pump 24, and an electric motor 28 serving as a drive source and having an output shaft 30 constituting a shaft of (a female rotor of; Refer to FIG. 3) the former-stage pump 22.

The vacuum pump further comprises a speed-up mechanism 34 intended for the power transmission between the shaft 30 and a shaft 32 of the latter-stage pump 24 and including a speed up driving gear 36 associated with the former-stage pump 22 and a speed up driven gear 38 associated with on the side of the latter-stage pump 24. As is apparent from FIG. 1, the number of teeth of the speed up driving gear 36 is much larger than that of the speed up driven gear 38 so that the number of revolutions of the latter-stage pump 24 is larger (higher) than that of the former-stage pump 22 by virtue of the speed up mechanism 34.

It is to be noted that reference numeral 6 and 7 denote a suction port and a discharge port, respectively, of the multi-stage screw vacuum pump in FIG. 1 as well as FIGS. 7 to 9. Although the communication passage 26 is shown entirely exposed in FIG. 1 for the purpose of simplification, all (FIG. 5) or most (FIG. 6) thereof is actually embedded within a casing.

Figure 2:
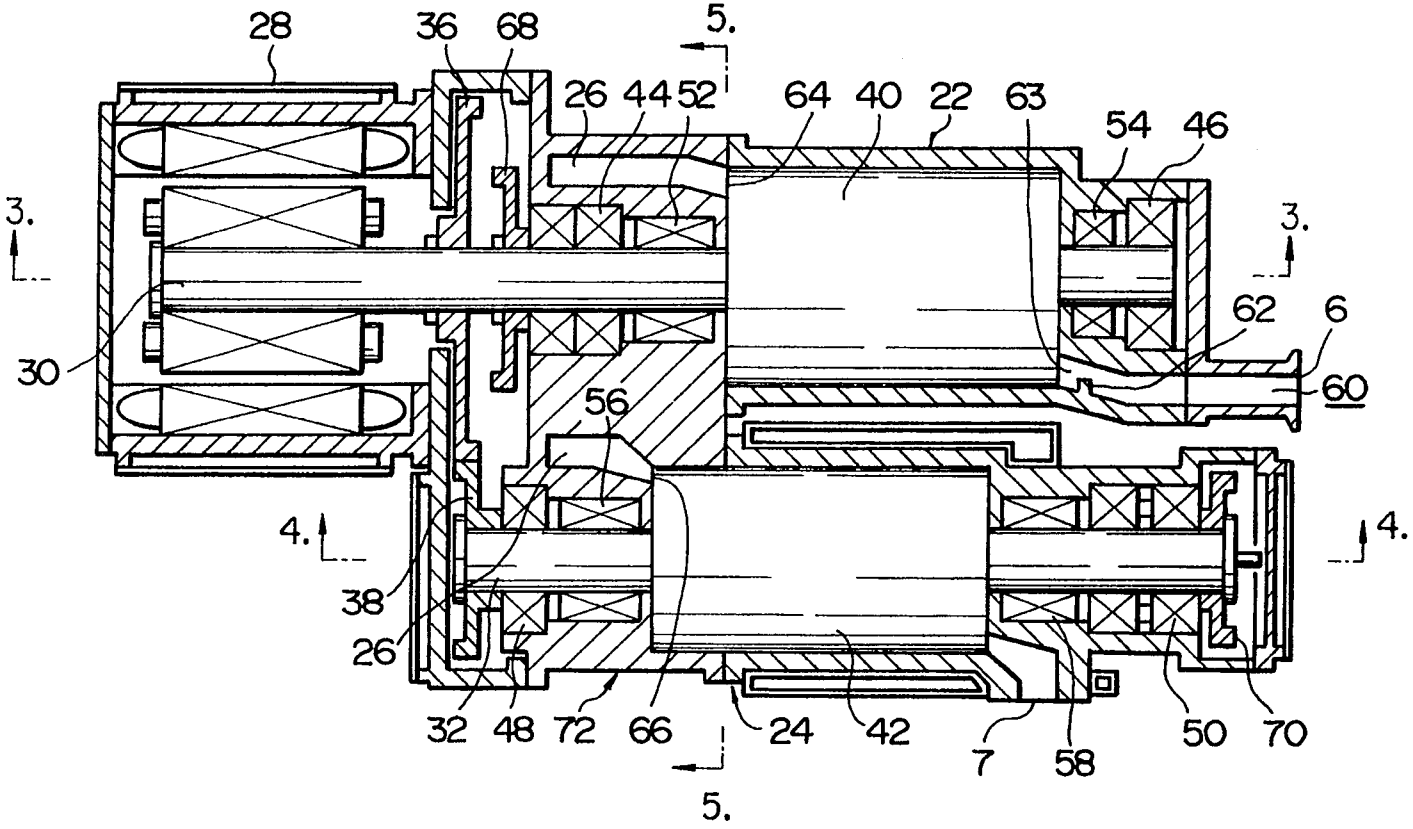
FIG. 2 is a sectional former-stage view for detailing the embodiment in FIG. 1.

FIG. 2 depicts a more concrete construction of this embodiment. Reference numerals 40 and 42 denote female rotors of the former-stage pump 22 and the latter-stage pump 24, respectively. The shaft 30 of the female rotor 40, that is, the output shaft of the motor 28 is supported on bearings 44 and 46, while a shaft 32 of the female rotor 42 of the latter-stage pump 24 is supported on bearings 48 and 50. The bearings 44, 46, 48 and 50 are arranged in pairs with shaft sealing devices 52, 54, 56, and 58, respectively, so as to constitute shaft sealing mechanisms. The shaft sealing mechanisms must be supplied with a sealing gas. Preferably, as disclosed in Japanese Patent Application No. 3-280667, the sealing gas from a sealing gas supply source is regulated at a given pressure by means of a gas pressure regulating means, is caused to diverge through a flow control valve or a throttle valve, and on the one hand is fed to the shaft sealing part on the discharge side, and on the other hand is fed to the shaft sealing part on the suction side by way of a further flow control valve or a throttle valve.

A restrictor 62 is formed on a passage 60 extending from the suction port 6 to the rotor (represented as the female rotor 40 in FIG. 2) of the former-stage pump 22. The restrictor 62 is provided in the vicinity of a suction port 63 of the former-stage pump 22 as a measure of preventing a power reduction at the time of starting or air-drawing of the screw vacuum pump (Refer to JP Appln. No. 3-276886, U.S. Ser. No. 07/942,031, EP Appln. No. 92 116354.9).

A working fluid (for example, air) flows through the former-stage pump suction port 63 into the rotor 40, and then by way of a former-stage pump discharge port 64, the communication passage 26, and the latter-stage pump suction port 66 into the female rotor 42 of the latter-stage pump 24. After having been processed through the female rotor 42, the working fluid is let out of the discharge port 6.

In FIG. 2, reference numerals 68 and 70 denote a timing gear, and 72 denotes a casing of the multi-stage screw vacuum pump.

FIG. 3 illustrates the former-stage pump 22 in detail. The former-stage pump 22 comprises the female rotor 40 and a male rotor 74. A shaft 76 of the male rotor 74 is supported on bearings 44A and 46A which are arranged in pairs with shaft sealing means 52A and 54A, respectively. On the shaft 76 of the male 74 there is provided an oil disk 78 which is intended to lubricate the former-stage pump 22 by "splash" in the illustrated embodiment.

In this case, a grease for lubrication may be applied to the bearings 46 and 46A on the suction side of the former-stage pump 22. Nevertheless, the bearings 44 and 44A on the discharge side and the timing gear 68 of the former-stage pump 22, and the bearings 48 and 48A on the suction side and the speed up gears 36 and 38 of the latter-stage pump 24 may be subjected to a lubrication by "splash" of the oil disk without using any compulsory oiling, since they are coextensive or positioned in the same space.

As described hereinabove, not only the output shaft 30 of the motor 28 but also the speed up driving gear 36 is linked to the shaft associated with the female rotor 40 of the former-stage pump 22. Advantageously, the gear ratio may be reduced providing that the speed up driving gear 36 is fitted to the shaft 76 of the male rotor 74 which is higher in revolutional speed than the shaft associated with the female rotor 40. This may, however, lead to a restriction in dimensions of the speed up (driving) gear due to a distance between the shaft of the female rotor 40 and the shaft 76 of the male rotor 74. Therefore, in the case where a significantly large speed up ratio is required,it is desirable that the speed up driving gear 36 be fitted to the shaft associated with the female rotor 40.

Figure 4:
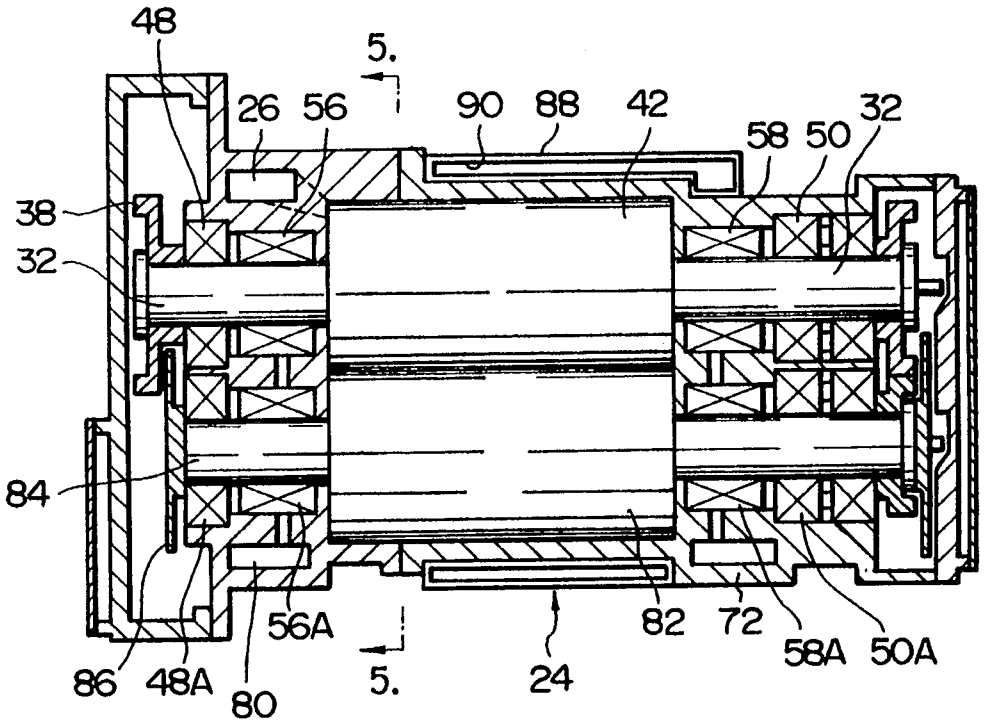
FIG. 4 is a sectional view taken along the line B—B in FIG. 2.

FIG. 4 illustrates the latter-stage pump 24 in detail. The latter-stage pump 24 comprises the female rotor 42 and a male rotor 82. The shaft 32 of the female rotor 42 has at its suction-side end the speed up driven gear 38. The shaft 32 is supported on the bearings 48 and 50, while a shaft 84 of tile male rotor 82 is supported on bearings 48A and 50A. The bearings 48, 50, 48A and 50A are at-ranged in pairs with the shaft sealing devices 56 and 58, and shaft sealing devices 56A and 58A, respectively. An oil disk 86 is provided on the shaft 84 of tile male rotor 82.

The latter-stage pump 24 is provided with a water cooling jacket 88 since former-stage is operated at a high-speed and hence the temperature reaches 300° C. or over in the region of the discharge port. In order to prevent a water cooling chamber 90 (whose position is not limited to that shown) of the cooling jacket 88 from being corroded, the interior of the water cooling chamber 90 is subjected to painting, coating, or spraying. Due to difficulty of application to uneven areas, preferably, the water cooling jacket 88 is made of a corrosion resistant member such as stainless steel and is fastened to the casing 72 by means of, for example, an adhesive having a higher thermal conductivity.

Since the bearings 50 and 50A on the discharge side are operated at high-temperature and high-speed, it is preferable to employ a means of internally lubricating the shafts. For example, the means may comprise a guide groove for collecting a lubricant flowing over the inner wall of a cover attached to the end of the casing, a suction nozzle for sucking the lubricant accumulating in the guide groove, a lubricating passage for supplying the sucked lubricant to the bearings by way of the interior of the rotational shafts, and an oiling nozzle which carries out a pumping action.

Referring next to FIGS. 3 and 4, there is shown an intermediate chamber designated at 80 and provided to prevent the lubricant from entering the interior of the rotors 40 and 74. In addition to the provision of the shaft sealing devices 52, 52A, 56, and 56A and the supply of the seal gas as described above, the intermediate chamber 80 is further provided to catch the lubricant penetrating into the interior of the rotors 40 and 74 over the shaft sealing devices, thereby establishing a secure prevention of penetration of the lubricant into the interior of the rotors 40 and 74. The intermediate chamber 80 may be allowed to communicate with both the former-stage pump 22 and the latter-stage pump 24, or alternatively, may be separately provided.

In FIGS. 2 to 4 showing the screw rotors 40, 42, 74 and 82, the total number of blades of the female and male rotors on the former-stage-stage is preferably less than that of the female and male rotors on the latter-stage-stage as described in Japanese Patent Laid-open Publication No. 4-31685.

It is also preferable to provide an expansion process for expanding the sucked gas between the suction process and the transfer process by earlier closing the suction port as described in Japanese Patent Laid-open Publication No. 3-195945. Similarly, the exhaust velocity of the latter-stage pump 24 is preferably the same as or greater than that of the former-stage pump 22 (as described in Japanese Patent Laid-open Publication No. 3-195945).

It is desirable in the suction port that a rotor rotational angle confining the capacity of a tooth space defined by the casing and female and male rotors be one including a tooth space capacity short of its maximum (Refer to Japanese Patent Application No. 3-195943). It is desirable in the discharge port that the tooth space capacity immediately after the gas has been confined be substantially equal to that immediately before the discharge (Refer to Japanese Patent Application No. 3-195943).

Figure 5:
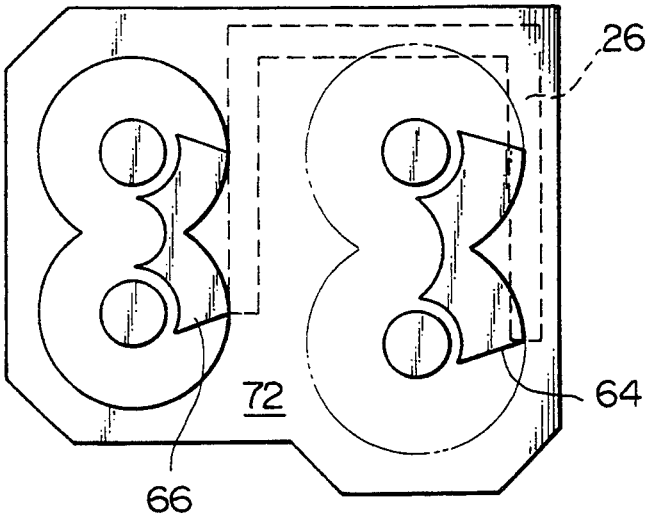
FIG. 5 is a sectional view taken along the line D—D in FIG. 2.
Figure 6:
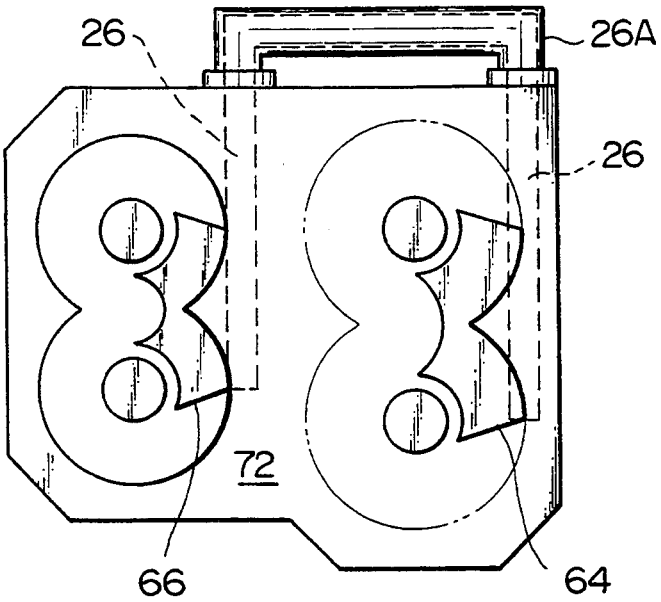
FIG. 6 is a sectional view of another embodiment different from the embodiment shown in FIG. 5, taken along the line D—D in FIG. 2.

FIGS. 5 and 6 illustrate the communication passage 26 through which the discharge port 64 of the former-stage pump 22 communicates with the suction port 66 of the latter-stage pump 24. The communication passage 26 may be entirely formed within the interior of the casing 72 as shown in FIG. 5. Alternatively, the communication passage 26 may be partially comprised of an external piping 26A of the casing 72 as shown in FIG. 6.

Although all the description has been hitherto given on the two-stage screw vacuum pump in the illustrated embodiment, the present invention is applicable to a multi-stage, that is, three-stage or more screw vacuum pump without requiring any specific constitutional conditions as is apparent to those skilled in the art.

EFFECT OF THE INVENTION (1) The present invention enables a reduction in tile number of constituent elements.

(2) The present invention facilitates a reduction in size.

(3) There is no need to use a high-frequency motor for inverter-drive irrespective of a high-speed operation requirement of the latter-stage pump.

(4) There is no need to support the drive source by the separate provision of further additional bearings.

(5) There is no need to provide the driven gear for each of the stages.

(6) The present invention will enable actuation or overload operation without need for any external auxiliary device.

What is claimed is:

1. A multi-stage screw vacuum pump comprised of plural stages of screw vacuum pump provided in series said plural stages including a former stage and a latter stage as viewed in a direction of flow of a fluid being pumped, each said stage including a male rotor and a female rotor rotatable around respective axes parallel to each other in a meshing manner, comprising:

an electric motor having a driving shaft drivingly mounted to a rotor shaft of said female rotor in said former stage screw vacuum pump to drive said former stage screw vacuum pump, said electric motor being overhung on a discharge end of said former stage screw vacuum pump, a speed up mechanism for transmitting drive from said rotor shaft to a latter stage screw vacuum pump while speeding up rotational speed of the drive from said rotor shaft, said speed up mechanism including a speed up driving gear provided on a discharge end of said former stage screw vacuum pump and a speed up driven gear driven by said speed up driving gear and provided on a suction end of said latter stage screw pump, said speed up driving gear being provided on said rotor shaft of said female rotor in said former stage screw vacuum pump, and said speed driven gear being provided on said female rotor in said latter stage screw vacuum pump, and timing gears for said former stage screw vacuum pump, said speed up driving gear and said speed up driven gear being positioned in a same space at said discharge end of said former stage screw vacuum pump, and an oil disk on a rotor shaft of said male rotor of said former stage screw vacuum pump for subjecting the speed up driven gear and speed up driving gear to splash lubrication.

2. A multi-stage screw vacuum pump as set forth in claim 1, wherein two rotor shafts of said male and female rotors of said former stage screw vacuum pump are respectively supported at both ends of said male and female rotors by bearings, each of which is provided with a shaft sealing device disposed adjacent to one of said male and female rotors.

3. A multi-stage screw vacuum pump as set forth in claim 1, including a discharge port of said former stage screw vacuum pump and suction port of said latter screw vacuum pump, said ports being comprised by a common casing.

4. A multi-stage screw vacuum pump as set forth in claim 2, wherein certain of said bearings are positioned adjacent to said same space at said discharge end of said former stage screw vacuum pump and are subjected to said splash lubrication by said oil disk.

* * * * *